US008149250B2

(12) United States Patent
Burkhardt et al.

(10) Patent No.: US 8,149,250 B2
(45) Date of Patent: Apr. 3, 2012

(54) GAMMA CURVE CORRECTION FOR TN AND TFT DISPLAY MODULES

(75) Inventors: Helmut Burkhardt, Heidelberg (DE); Achim Stellberger, Kronan (DE); Paul Zehnich, Altrip (DE); Frank Kronmuller, Neudenau (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 1296 days.

(21) Appl. No.: 11/190,621

(22) Filed: Jul. 27, 2005

(65) Prior Publication Data

US 2007/0013725 A1 Jan. 18, 2007

(30) Foreign Application Priority Data

Jul. 18, 2005 (EP) ..... 05392012

(51) Int. Cl.
*G09G 5/10* (2006.01)
*G09G 3/36* (2006.01)

(52) U.S. Cl. ..... 345/690; 345/89

(58) Field of Classification Search ..... 345/690–693, 345/204, 208–210, 89; 315/169.1–169.4
See application file for complete search history.

(56) References Cited

U.S. PATENT DOCUMENTS 5,012,272 A * 4/1991 Tabata et al. ..... 396/284
6,008,788 A * 12/1999 Ishimaru ..... 345/98
6,359,389 B1 3/2002 Medina et al. ..... 315/169.1
6,404,512 B1 * 6/2002 Tone ..... 358/3.01
6,437,716 B2 8/2002 Nakao ..... 341/118
6,731,259 B2 5/2004 Yer et al. ..... 345/89
2002/0075277 A1 * 6/2002 Naito et al. ..... 345/589
2002/0079484 A1 * 6/2002 Yamazaki et al. ..... 257/10
2002/0186230 A1 * 12/2002 Kudo et al. ..... 345/690
2003/0085859 A1 * 5/2003 Lee ..... 345/87
2003/0184568 A1 * 10/2003 Date et al. ..... 345/690
2004/0066363 A1 * 4/2004 Yamano et al. ..... 345/98
2004/0113924 A1 * 6/2004 Jeong ..... 345/690
2004/0150653 A1 * 8/2004 Sakamaki et al. ..... 345/592
2004/0174388 A1 * 9/2004 Sempel et al. ..... 345/691
2004/0246221 A1 * 12/2004 Izumi ..... 345/94
2006/0202929 A1 * 9/2006 Baum et al. ..... 345/89

OTHER PUBLICATIONS

*Liquid Crystal Displays*, by Ernst Lueder, May 2001, Ed-1, John Wiley & Sons, retrieved from the internet on Jul. 28, 2005: http://www.wiley-vch.de/publish/en/book/bySubjectEE00/bySubSubjectEE35/0-47-490....

* cited by examiner

*Primary Examiner* — Chanh Nguyen
*Assistant Examiner* — Robert Stone
(74) *Attorney, Agent, or Firm* — Saile Ackerman LLC; Stephen B. Ackerman

(57) ABSTRACT

A circuit and methods eliminating production related luminance variations of electronic display applies to all display technologies that require gamma adjustment or also adjustment of other display parameters e.g. brightness or contrast as e.g. LCD or OLED display modules are disclosed. This is performed by individual trimming of the display driver's gamma curve One alternative is that an end-user has access to a non-volatile memory and replaces the factory default settings of the gamma curve with individual settings. Another alternative is to load gamma curve parameters from the non-volatile memory to gamma control registers and perform tweaking of the gamma curve from these control registers on top of the factory default settings in the non-volatile memory.

3 Claims, 4 Drawing Sheets

GAMMA CURVE CORRECTION FOR TN AND TFT DISPLAY MODULES

BACKGROUND OF THE INVENTION (1) Field of the Invention

This invention relates generally to electronic displays and relates more particularly to gamma curve correction for display modules.

(2) Description of the Prior Art

The gamma curve is a mathematical function that describes the non-linear tonal response of many monitors. A tone map that has the shape of this its compensating function cancels the non-linearities in monitors.

The luminance of a liquid crystal display (LCD) is dependent on the voltage across the liquid crystal and the properties of the liquid crystal itself. The use of liquid crystals from different suppliers as well as production lot variations affect the luminance of a LCD display. The LCD display module manufacturers supply the settings for the gamma curve of the display drivers of their displays to adjust for typical LCD display parameters. These typical gamma curve parameters are then loaded into the application program of the related LCD display drivers.

Variations of display module parameters cause variations of luminance of individual displays. It is sometimes necessary to adjust the application program of an LCD display driver to reflect the specific LCD display parameters.

There are various patents known to adjust the gamma curve of LCD displays:

U.S. Pat. No. 6,359,389 (to Medina et al.) describes a flat panel display having a programmable gamma without incidental loss in grayscale resolution. In one embodiment, the flat panel display is a liquid crystal display (LCD). The invention includes applying and adjusting a set of gamma controlling voltages to the DC reference circuit (a.k.a. ladder voltages) of an LCD module producing a change in the gamma response (or profile) of the LCD module without incidental loss of grayscale resolution. An adjustable ladder circuit (ALC) is thereby realized. Separate ALCs can be provided for red, green and blue primaries. By adjusting, in a predetermined fashion, the reference voltages applied to the row and column drivers of an LCD display, the gamma response of the LCD can be changed to a different value. Because the input digital signals are not affected, the same color resolution and dynamic range are maintained. The DC reference circuit can be a multi-node voltage divider. These voltage nodes are applied to the row and column drivers of the LCD module to control the ON/OFF states of each red, green and blue sub-pixel. The input digital signals provided by the host's graphic source or software application modulate these voltage nodes to produce the desired grayscale value applying across the LCD sub-pixel a percentage of DC reference voltages.

U.S. Pat. No. 6,437,716 (to Nakao) discloses a grayscale display reference voltage generating circuit that can change a gamma correction characteristic in accordance with a liquid crystal material and LCD panel characteristics. Resistor elements R0 through R7 have a resistance ratio for gamma correction and generate gamma-corrected intermediate voltages on the basis of voltages across both input terminals V0 and V64. A gamma correction adjustment circuit 42 adjusts the gamma-corrected intermediate voltages upward or downward on the basis of adjustment data latched in a data latch circuit 43. By thus supplying the adjustment data corresponding to the liquid crystal material and the LCD panel characteristics to the data latch circuit 43, the gamma correction characteristic can be changed in accordance with the liquid crystal material and the LCD panel characteristics without modifying the design of a source driver.

U.S. Pat. No. 6,731,259 (to Yer et al.) discloses a driving circuit of an LCD device compensating a gamma voltage according to a peripheral environment so that exact picture images can be displayed. The driving circuit of the LCD device includes a memory dividing the peripheral environment into a plurality of modes and storing information of each mode, an environment sensor sensing variation of the peripheral environment, a controller selecting information of a mode corresponding to the resultant value sensed by the environment sensor, a digital variable resistor adjusting a resistance value to correspond to mode information selected by the controller, and a gamma voltage outputting unit outputting a plurality of gamma voltages corresponding to the adjusted resistance value.

SUMMARY OF THE INVENTION

A principal object of the present invention is to eliminate production related luminance variations of electronic display modules.

In accordance with the objects of this invention a method to eliminate production related luminance variations of electronic display modules has been achieved. This method comprises, first, to provide a display driver IC having a non-volatile memory. Following steps of the method invented are to write specific gamma curve parameters into said non-volatile memory, to have specific gamma curve parameters available stored previously in said non-volatile memory, and to control grayscale generation circuit of said display driver by said specific gamma curve parameters. Thus an electronic display having reproducible luminance is achieved.

In accordance with the objects of this invention an alternative method to eliminate production related luminance variations of electronic display modules has been achieved. This method comprises, first, to provide a display driver IC having a non-volatile memory and gamma control registers. Following steps of the method invented are to write specific gamma curve parameters into said non-volatile memory, to load these registers with specific gamma curve parameters stored in previous step, to have specific gamma curve parameters available from these registers, and to tweak the gamma curve until best results is achieved and optimal gamma curve parameters can be stored in gamma curve registers. The next step comprises to control grayscale generation circuit of said display driver by said specific gamma curve parameters. Thus an electronic display having reproducible luminance is achieved.

In accordance with the objects of this invention a circuit to eliminate production related luminance variations of electronic display modules has been achieved. This circuit comprises, first, an MPU interface block having inputs and outputs, wherein the inputs are display control information, display address information and gamma curve parameters and receiving feedback from a non-volatile memory, a display RAM, and from a control block for voltage generation and display and timing and the outputs control said non-volatile memory storing said gamma curve parameters, said display RAM and said control block controlling voltage generation and display and timing. Furthermore the circuit comprises said control block controlling voltage generation and display and timing having input and outputs, wherein said input is from said MPU interface and the outputs are the input of a voltage generation system and the input of a display and timing control block and feedback to said MPU interface, said voltage generation system having an input and outputs, wherein the input is from said control block controlling voltage generation and display and timing and the outputs provide power supply to means for digital-to-analog conversion, amplifiers to provide gate output to a display and blocks to provide source output to a display, and said display and timing control block controlling said amplifiers and said display RAM. Additionally the circuit comprises said display RAM connected to said MPU interface and to said source output blocks, said gate output amplifiers, said source output blocks, receiving input from said display RAM and said means for digital-to-analog conversion, said means for digital-to-analog conversion receiving input from said non-volatile memory, and, finally, said non-volatile memory.

BRIEF DESCRIPTION OF THE DRAWINGS

In the accompanying drawings forming a material part of this description, there is shown.

DESCRIPTION OF THE PREFERRED EMBODIMENTS

Figure 1:
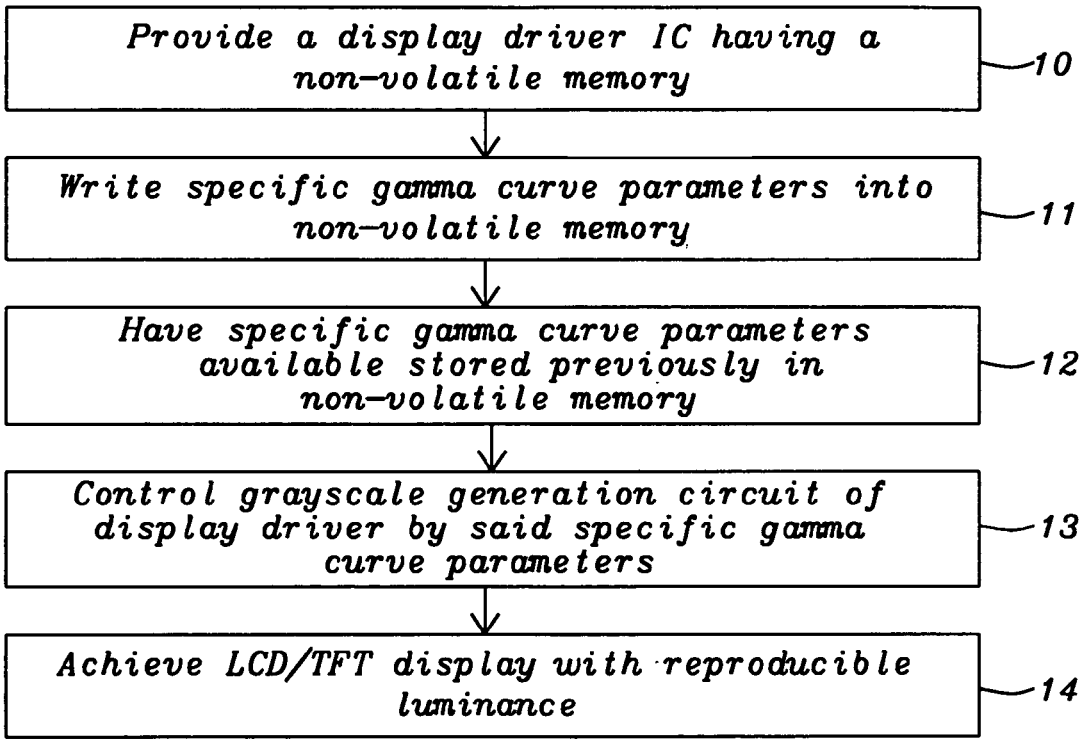
FIG. 1 shows a flowchart of a method to eliminate production related luminance variations of electronic display modules.

The preferred embodiments disclose methods enabling the elimination of production related luminance variations of twisted nematics (TN), thin film transistor (TFT) LCD display modules, or organic light-emitting diode (OLED) displays. This invention also applies to OLEDs and any other display technology that requires gamma adjustment or also adjustment of other display parameters e.g. brightness or contrast The methods and circuits invented require a display driver IC having a non-volatile memory e.g. a fuse based, a flash based, a mask programmable, or another non-volatile memory to adjust the gamma curve of the driver IC to the luminance parameters of an individual display module. This trimming of the gamma curve can be performed on a production lot base or for every single module.

The applicable gamma curve values can be derived from raw material parameters (glass, liquid crystals and color filters) or from gamma curve measurements of sample display modules or of every single display module.

The required gamma curve parameters of the individual display modules are written to the non-volatile memory of the driver IC either during production or test of the display driver IC or during production or test of the display module. Using these parameters stored in the non-volatile memory it is possible to perform an on-chip gamma curve adjustment for individual display modules.

The data stored in the non-volatile memory can either be used to directly control the gamma curve of the display driver or to automatically load the gamma curve registers of the display driver during power-up or during an application to tweak the individual gamma curve.

The individual gamma curve parameters control the grayscale generation circuit of the display driver IC, generating the correct voltages and driving waveforms for the LCD module. Both methods described above, the direct control of the gamma curve of the display driver or the presetting of the control registers, result in repeatable luminance values of the display module.

Presetting the IC drivers gamma curve control registers with the individual gamma curve stored in the non-volatile memory during power-up of the display driver IC or during the application allows additionally the tweaking of displays luminance (gamma curve) in the application.

In prior art using the gamma curve from a non-volatile memory meant that every time the system is switched on it comes with the gamma default values provided by the factory. Using the direct control of the present invention the end-user has access to the non-volatile memory and the system comes up with the user's individual settings. The default gamma settings provided by the factory are lost in this case.

Alternatively the gamma curve is written to a non-volatile memory and gamma control registers are loaded after power on. This means that the gamma default settings by the factory remain in the non-volatile registers and the tweaking of the gamma curve is done by the end user on top of the default setting by the factory.

FIG. 1 shows a flowchart of the method invented to eliminate production related luminance variations by individual trimming of related gamma curves of the display drivers. The method invented is applicable to all display technologies that require gamma adjustment or also adjustment of other display parameters e.g. brightness or contrast. The first step 10 illustrates the provision of an electronic display and of a display driver having a non-volatile memory. The following step 11 comprises the writing of specific gamma curve parameters into said non-volatile memory. In the next step 12 the system comes up with the individual settings of the gamma curve and these settings, which have been stored in the previous step 11, are available now. This is followed by step 13 describing the control of the grayscale generation circuit of the display driver by said specific gamma curve parameters and finally, in step 14, an electronic display having reproducible luminance has been achieved.

Figure 2:
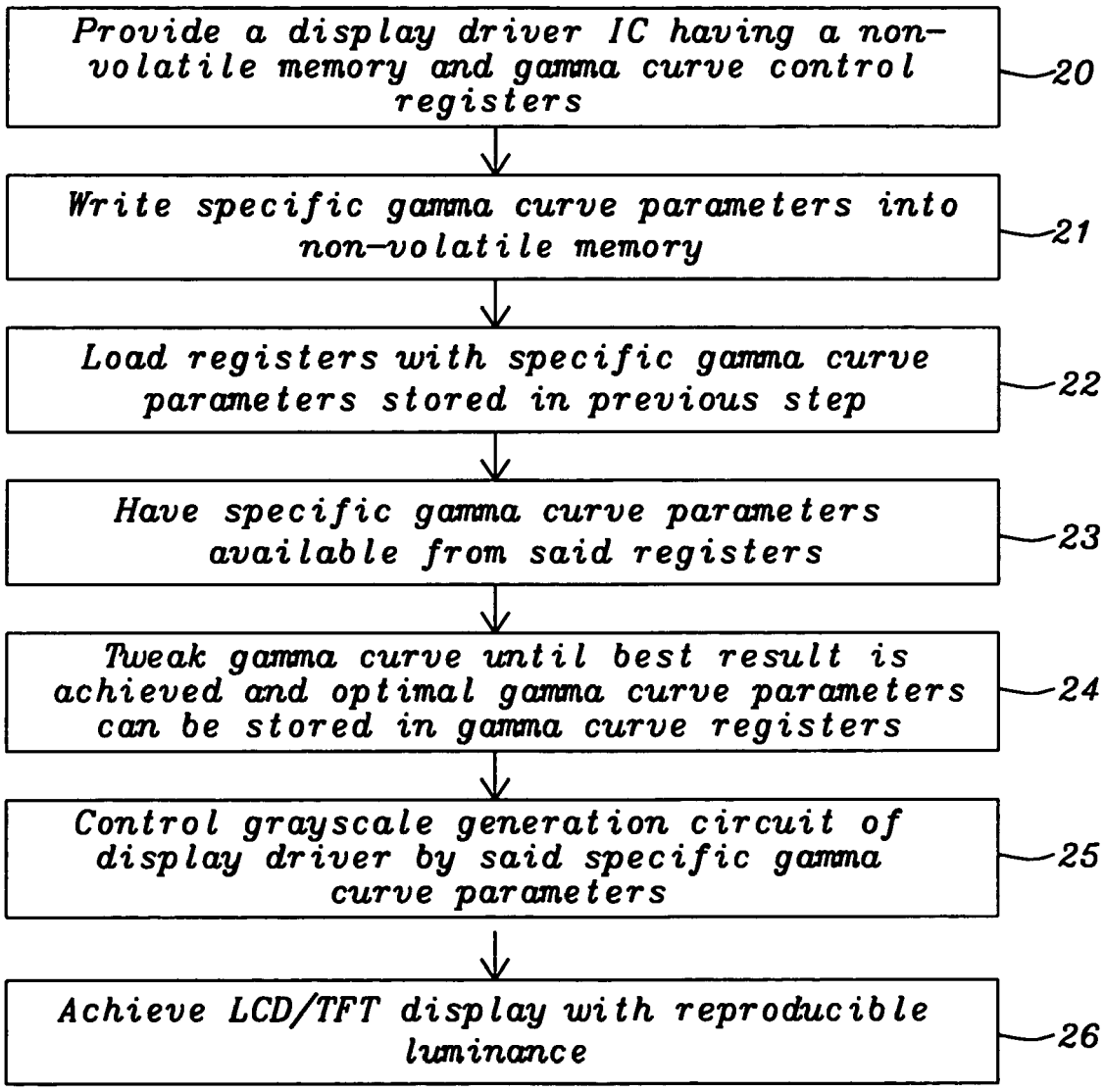
FIG. 2 shows a flowchart of an alternative method to eliminate production related luminance variations of electronic display modules.

FIG. 2 shows a flowchart of an alternative method invented to eliminate production related luminance variations by individual trimming of related gamma curves of the display drivers. The method invented is applicable to all display technologies that require gamma adjustment or also adjustment of other display parameters e.g. brightness or contrast. The first step 20 illustrates the provision of an electronic display and of a display driver having a non-volatile memory and gamma curve control registers. The following step 21 comprises the writing of specific gamma curve parameters into said non-volatile memory. In the next step 12 the gamma curve control registers are loaded with these specific gamma curve parameters and these settings, which have been stored in the previous step 21 and loaded into registers in step 22 are available now in step 23. In step 24 the gamma curve can be tweaked until best result is achieved and optimal gamma curve parameters can be stored in the gamma curve registers. This is followed by step 25 describing the control of the grayscale generation circuit of the display driver by said specific gamma curve parameters and finally, in step 26, an electronic display having reproducible luminance has been achieved.

Figure 3:
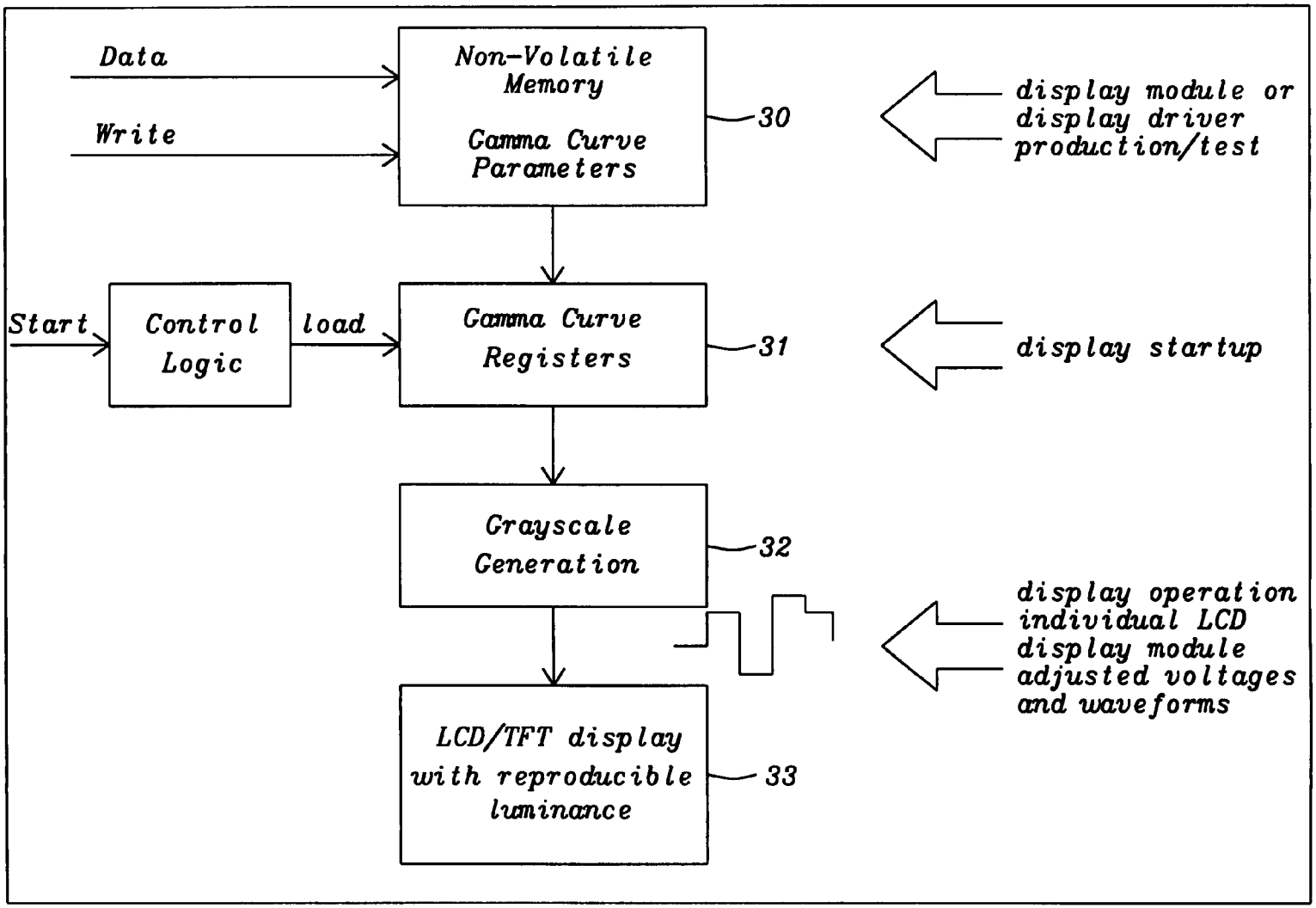
FIG. 3 shows a generalized block diagram of the process invented to eliminate production related luminance variations of electronic display modules

FIG. 3 shows a more generalized block diagram of the present invention. The first block 30 illustrates the writing of the gamma curve parameters into a non-volatile memory. This writing operation can be performed either during test or production of either a display module or of a display driver. The next step 31 illustrates that a control logic controls the loading of these gamma curve parameters from the non-volatile memory into gamma curve registers. This load operation can be performed either during start-up of the display driver or as part of an application program for gamma curve tweaking. Alternatively a display driver can directly access the gamma curve parameters in the non-volatile memory; in this case step 31 is omitted. The following block 32 illustrates the grayscale generation, wherein the voltages and waveforms are adjusted using the gamma curve parameters and the last block 33 illustrates that using the invention presented an LCD/TFT display can be achieved with reproducible luminance.

Figure 4:
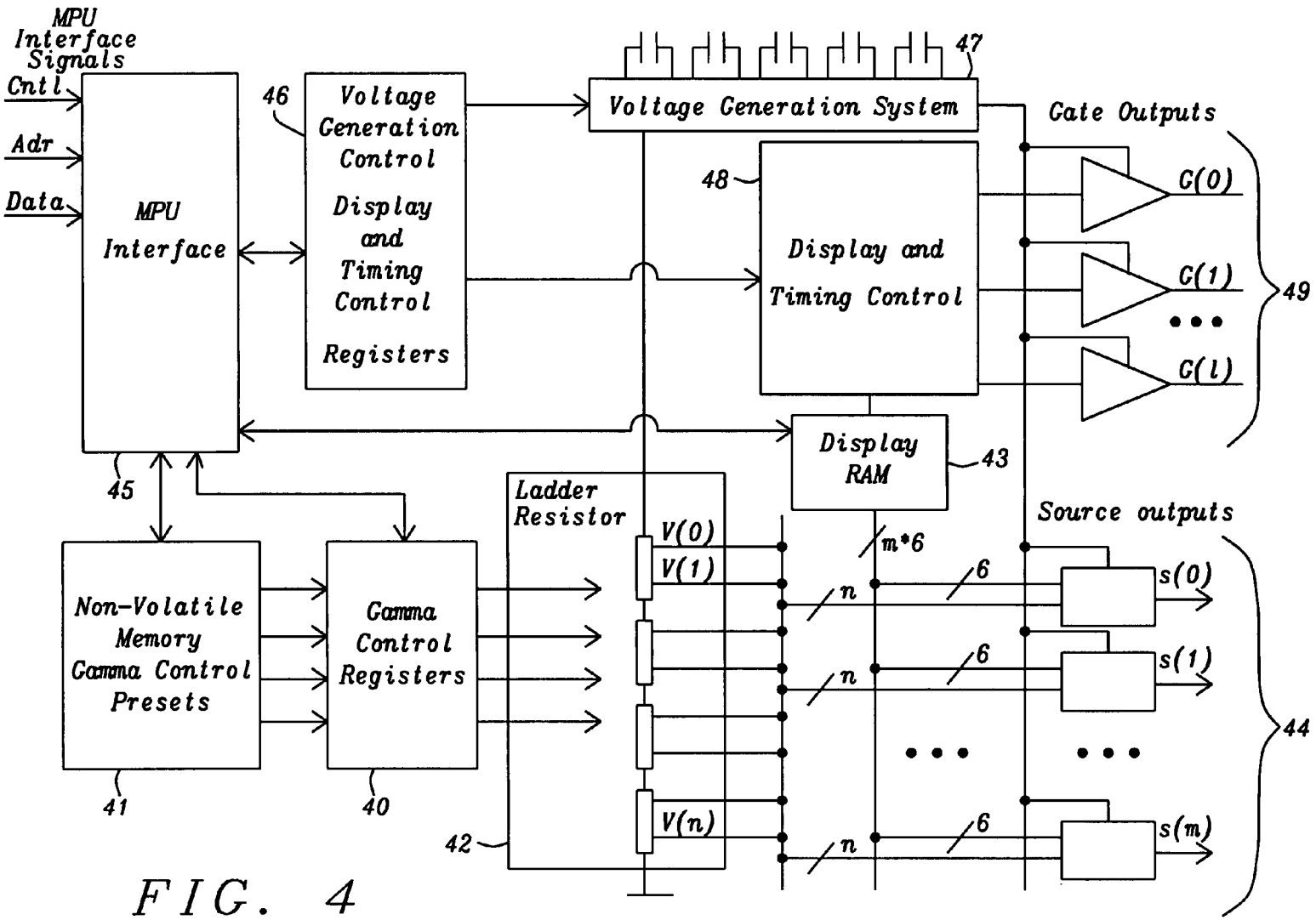
FIG. 4 shows a circuit to eliminate production related luminance variations of electronic display modules.

FIG. 4 shows a preferred embodiment of a circuit according the present invention showing a display driver having gamma control registers 40, being connected to a non-volatile memory 41 and to a ladder resistor block 42 providing output voltages to perform the gamma correction of the output voltage of a display RAM 43. The gamma control registers 40 are optional. They are not required if a direct control of the gamma curve is selected as described above. The gamma control registers 40 are required if the method of tweaking the gamma curve using gamma control registers is selected.

The ladder resistor block 42 comprises resistors and switches and performs a digital-to analog conversion of the output voltages of either the non-volatile memory 41 or, if present, of the gamma control registers 40. The blocks 44, providing the gamma corrected source outputs receive inputs from the display RAM 43 and from the ladder resistor block 42 providing the gamma correction voltages.

The MPU interface 45 receives control and address information, display data and gamma curve related data. This MPU interface 45 is connected to the non-volatile memory 41, to the optional gamma control registers 40, to the display RAM 43, and to a block 46, comprising the control of the generation of voltage required for the electronic display, the control of display and timing and additional registers. This block 46 controls a voltage generation system 47 and a display and timing control block 48.

The voltage generation system provides voltage for the ladder resistor block 42 and for the gate output blocks 49 and the source output blocks 44. The display and timing control block 48 controls the display RAM 43 and the gate output blocks 49.

In summary, the advantages of the methods invented are:

To prevent display module luminance variations

Production lot independent luminance of display module

Reproducible luminance of individual display modules

Support of multiple sources of liquid crystals by fitting the display driver ICs gamma curves to the individual liquid crystals parameters Adaptation of gamma curves on chip instead in an application Application program is independent of the gamma curve of a display While the invention has been particularly shown and described with reference to the preferred embodiments thereof, it will be understood by those skilled in the art that various changes in form and details may be made without departing from the spirit and scope of the invention.

What is claimed is:

1. A circuit for an electronic display driver IC to eliminate production related luminance variations of electronic display modules comprising:

only one display driver IC comprising:

an MPU interface block having inputs and outputs, wherein the inputs are display control information, display address information and gamma curve parameters and receiving feedback from a non-volatile memory, gamma control registers, a display RAM, and from a control block for voltage generation and display and timing and the outputs control said non-volatile memory storing said gamma curve parameters, said display RAM and said control block controlling voltage generation and display and timing;

said control block controlling voltage generation and display and timing having input and outputs, wherein said input is from said MPU interface and the outputs are the input of a voltage generation system and the input of a display and timing control block and feedback to said MPU interface;

said voltage generation system having an input and outputs, wherein the input is from said control block controlling voltage generation and display and timing and the outputs provide power supply to means for digital-to-analog conversion, amplifiers to provide gate output to a display and blocks to provide source output to a display;

said display and timing control block controlling said amplifiers and said display RAM;

said display RAM connected to said MPU interface and to said source output blocks;

said gate output amplifiers;

said source output blocks, receiving input from said display RAM and said means for digital-to-analog conversion;

said gamma control registers, wherein gamma curve parameters were loaded from said non-volatile memory during power-up of said display driver IC and wherein the gamma control registers are placed between said non-volatile memory and said means for digital-to-analog conversion, wherein gamma curve tweaking is done from the individual settings of the gamma curve parameters stored in said gamma control registers;

said means for digital-to-analog conversion receiving input from said gamma control registers; and said non-volatile memory holding gamma-curve parameters.

2. The circuit of claim 1 wherein said means for digital-to-analog conversion is a ladder resistor block.

3. The circuit of claim 1 wherein said electronic display module comprises any display technology that requires gamma adjustment.

* * * * *